US007293759B2

(12) United States Patent
Beach et al.

(10) Patent No.: US 7,293,759 B2
(45) Date of Patent: Nov. 13, 2007

(54) ACCESS SPACE COVER LIFTING DEVICE

(76) Inventors: Bill Beach, 1629 St. Clair St., Jacksonville, FL (US) 32254; Paul McMullan, 4561 Merson La., Jacksonville, FL (US) 32205

( * ) Notice: Subject to any disclaimer, the term of this patent is extended or adjusted under 35 U.S.C. 154(b) by 0 days.

(21) Appl. No.: 11/394,689

(22) Filed: Apr. 1, 2006

(65) Prior Publication Data

US 2007/0228346 A1 Oct. 4, 2007

(51) Int. Cl.
*B66F 3/00* (2006.01)

(52) U.S. Cl. ..... 254/131; 254/120

(58) Field of Classification Search ..... 254/131, 254/131.5, 132, 120; 294/17
See application file for complete search history.

(56) References Cited

U.S. PATENT DOCUMENTS 1,158,232 A * 10/1915 Grau et al. ..... 165/112
4,991,893 A * 2/1991 Gordon et al. ..... 294/17
5,462,385 A 10/1995 Mohlengraft
5,775,674 A * 7/1998 Bigham ..... 254/131
6,520,482 B1 2/2003 Bigham
6,676,111 B2 1/2004 Bigham
6,964,407 B1 * 11/2005 Butler ..... 254/131

* cited by examiner

*Primary Examiner*—Lee D. Wilson
(74) *Attorney, Agent, or Firm*—Arthur G. Yeager

(57) ABSTRACT

A cover lifting device for lifting a cover having two spaced lifting holes includes an elongate lever, a lifting hook affixed to one end portion for engagement with one hole, a sleeve freely slideably mounted between lever ends and another lifting hook, a flexible element attaches the second hook to the sleeve. The second hook has a shank with a straight axis and a lower gripping element. The improvement includes an upper connecting portion extending laterally of the axis and in an opposite direction to the element. The connecting portion has an opening to connect the element, which is offset from the axis to rotate the hook when a lifting force is applied at the opening.

18 Claims, 3 Drawing Sheets

ACCESS SPACE COVER LIFTING DEVICE

CROSS-REFERENCE TO RELATED APPLICATION

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

The present invention relates to improved access space cover lifting tools. More specifically, the invention relates to a lever-type manual tool for lifting and maneuvering manhole covers and gratings of various sizes away from respective manholes, wherein a freely slidable sleeve mounted on the lever permits a virtually infinite range of adjustments of the distance between the fulcrum and the sleeve, thereby enabling the tool to be used with any size cover while maximizing the available leverage.

2. Related Art

There are a number of manhole cover lifting devices disclosed in the prior art. For example, in one, a lever is combined with scissors-type lifting means for lifting a manhole cover and pivoting the raised cover away from the manhole in a horizontal plane.

In another, a lever-type manhole cover lifting tool is combined with a hydraulic jack, hydraulic cylinder, or pulley cable to facilitate lifting of the cover and thereafter pivoting the cover away from the manhole.

Other devices include manually operated lever-type lifting tools in which one or more points of attachment for a member connected to the manhole cover are fixed along the length of the lever. Flexible chains may be connected between the selected, fixed points of attachment on the lever and lifting elements attached to the manhole cover. However, because the attachment points are fixed, the chain must be adjustable in length to accommodate manhole covers of different diameter. This arrangement is unsatisfactory since it is not possible to maximize leverage, and additional hardware is often required to insure secure attachment of the chain links to the various fixed points of attachment.

Manhole cover diameters may be 34 inches in diameter. Accordingly, there is a need for a manhole cover lifter tool which is simple and easy to use, which maximizes leverage, and which accommodates all manhole cover sizes as well as various grating covers.

A more recent lifting device, U.S. Pat. No. 4,991,893, is limited by the length of the sliding sleeve which is too short for optimum load bearing. The tool lever member is also too short to achieve maximum leverage. Other features include hook members that do not provide adequate gripping of very large and heavy covers.

Other examples of cover lifting devices that are known to the prior art include U.S. Pat. Nos. 5,462,385; 6,520,482; 6,676,111; and 6,964,407.

BRIEF SUMMARY OF THE INVENTION

In one aspect of the present invention there is provided an access space cover lifting device for lifting an access cover having at least two spaced lifting holes or slots therein, an elongated rod for use as a lifting lever, the rod having respective first and second end portions, a first lifting hook affixed to the end portion for engagement with a first of such holes or slots, a sleeve freely slideably mounted on the rod between the end portions, a second lifting hook, a flexible elongated element attaching the second hook member to the sleeve, the second hook member having a shank with a straight axis and a lower gripping element, the improvement comprising an upper connecting portion and extending laterally of the axis and located substantially in an opposed direction with respect to the gripping element, the connecting portion having an opening to connect the flexible element thereto, the opening being offset from the axis to provide a force tending to rotate the hook member into engagement of the hook member with a manhole cover when a lifting force is applied at the opening. The shank and the gripping element are formed of round metal stock. The shank, the element and the connecting portion are in a same plane and the flexible element is a chain.

The first end of the rod includes an opening therethrough, at least one fastener passing through both the openings to attach the first hook member to the rod. The rod includes a grip opening therethrough in the second end portion, an elongate strap member threaded through the grip opening for providing a secure grip for a user using the lifting device.

In another aspect of the present invention there is provided a second hook having a shank with a straight axis having a lower leg element and the improvement comprising an upper connection member having a first portion formed at a first angle to the axis, a second portion disposed laterally from the first portion. The hook member is formed of flat metal stock and the second lifting means includes a chain for attaching the hook member to said sleeve. The first angle is approximately a 70° angle; the second angle is approximately 10°; the axis is disposed at a substantially right angle from the leg element; and alternately, the second angle is within the range of 5°-15°.

The first end of the rod includes an opening therethrough; the first hook member includes a shank having at least one hole therethrough, at least one fastener passing through both the openings to attach the first hook member to the rod. The rod includes a grip opening therethrough in the second end portion, an elongate strap member threaded through the grip opening for providing a secure grip for a user using the lifting device.

In another aspect of the present invention there is provided a second hook member having a shank with a straight axis, and a lower gripping element and the improvement comprising an upper flange extending laterally of the axis and located substantially in an opposite direction with respect to the gripping element, the flange having an opening for connecting the flexible element thereto, the opening being offset from the axis to provide a force tending to rotate the hook member into engagement of the hook member with an access space cover when a lifting force is applied at the opening. The shank, the element and the flange are in a same plane. The first end of the rod includes an opening therethrough; the first hook member includes a shank having at least one hole therethrough, at least one fastener passing through both openings to attach the first hook member to the rod.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE INVENTION

Figure 1:
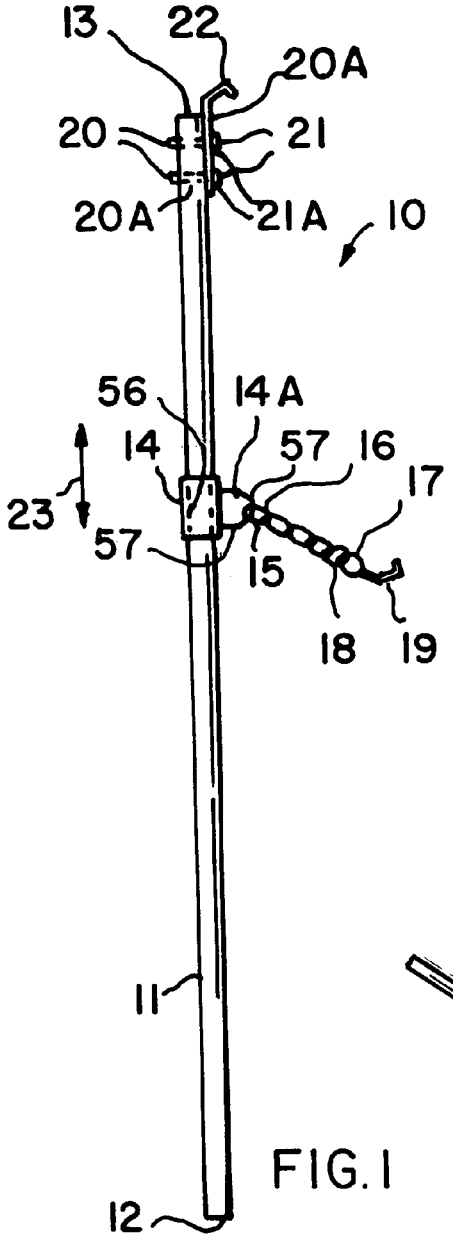
FIG. 1 is a plan view of one embodiment of the lifting device in accord with the present invention.

The sewer manhole and cover (lid) are both scientifically designed to meet and to perform specific needs within the total wastewater and sewage systems. The devices are required to maintain continuous containment of the millions of gallons of sewage that constantly flows from its origin to the point of treatment and/or discharge, to contain the odors of the sewage, to provide for an egress and ingress into the sewage system by qualified individuals and to prevent trespassing into the sewage systems by non-authorized persons.

Therefore, the manholes and the covers are designed, manufactured, installed and maintained in a specific manner for the purpose of insuring a long service life and functional operations of the structures, and the covers while withstanding continuous heavy load bearings upon them caused by vehicles passing over them on a continuous basis.

Because the sewer systems experience hydraulic surges due to flood conditions and sewer backups, the covers must be manufactured to fit the manhole with a minimum of space between the inside surface of the manhole ring in which the cover is placed and the outer circumference of the manhole cover and to be heavy enough to withstand considerable upward, or outward surging pressure of the sewage and maintain its position inside of the manhole ring for security reasons, and to minimize the sewage odors associated with the sewage.

In addition to the above factors, the manholes are exposed to the elements in which rust and gasses induce material fatigue, long settling into the ground of the entire manhole structure itself and the continuous heavy traffic running over the manhole covers means that the manhole covers must be designed to maintain their strength integrity against all of these conditions. The manufacturing of the covers is accomplished providing the absolute smallest eyelets, or hook holes possible in order to prevent weakening of the covers.

Due to the configuration and the weight of the manhole covers, (round in design, up to 34 inches in diameter, weight up to 240 lbs.) containing very small eyelets for any type of tool, hook or lifting device to be affixed, some manholes being situated at above ground levels, or in extreme locations, the covers must not only be lifted vertically, but they must be completely removed from the manhole rings.

Therefore, in order to open up the entire manhole for accessibility, the attachment of the lifting device must maintain secure clamping or gripping to the manhole cover at all times during the complete removal or replacement operation and also be capable of providing the adequate lifting leverage that will enable an average person to facilitate any maneuvers necessary in order to remove and, or replace the covers and to do so in an efficient and expedient manner without the user losing his or her secure gripping of the manhole cover.

There are many different sizes and weights of manhole covers. The smaller and lighter covers are easily removed and replaced with a variety of tools or devices. It is the large, heavy and cumbersome covers that require a certain design of tool or device for successful maneuvering.

The instant either side of the large manhole cover is lifted upward from its normal position due to the round outside circumference of the cover and the round inside circumference of the manhole where the cover was previously resting, the cover will immediately shift its position towards the person attempting to remove the cover. The cover will not fall into the manhole because the inside diameter of the manhole ring is less than the outside diameter of the manhole cover.

It is at this juncture of the maneuver that the hooks or clamping devices on the tool or item being used to remove the cover must have the capacity to physically lock into the manhole cover eyelets the lifting hooks or clamps with the security and strength that will be necessary to control the manhole cover at all times throughout the operations.

In addition to securely locking the lifting tool to the manhole cover for the initial lifting movement, the tool must have the capacity to provide adequate leverage and stability necessary to allow an average person to control the cover on all surfaces that may be encountered by the user.

All of these specifications set forth in the above descriptions with regard to both the locking and gripping capacity of the manhole cover lifting device require that the device be designed to respond to the changing needs without the user making such changes to the tool or device to meet the changing conditions to be encountered during the maneuvers.

The present tool incorporates a security and lifting hook design that grips the hook to the manhole cover the instant the user affixes the lifting and securing hook to the manhole cover and provides the grip and security of the hook to the cover to increase proportionately as the upward lifting force applied by the user increases. This unique feature provides the user with the necessary control of the manhole cover at all times during the lifting, maneuvering and replacement process. The present device also includes a grating cover lifting tool.

Operation

The user affixes the pulling end hook of the tool to the outer perimeter of the manhole cover by inserting the hook of the tool into the manhole cover eyelet located on the opposite side of the manhole cover where the user is now positioned. In the event the eyelet is clogged with mud, sand or other debris, the user removes such obstruction and then attaches the pulling hook to the manhole cover.

The user then inserts the security and lifting hook of the tool to the outer perimeter of the manhole cover on the nearside by using the same type of manhole cover eyelet and lifts the shaft handle upward to remove the slack from the lifting chain and hook.

The initial upward lifting force applied by the user brings the upper (lifting) side of the security and lifting hook in direct contact with the underside of the manhole cover and creates a 1 square inch area surface of contact between the security and lifting hook and the manhole cover which will be the attachment cohesive factor in controlling the manhole cover during all of the various maneuvering of the manhole cover by the user.

As the user increases the lifting force required to raise the manhole cover from the current position in order for the user to remove the cover, the additional lifting force increases the contact force between the two surfaces which correspondingly increases the security and control of the manhole cover by the user.

It is crucial that the security and lifting capability of the lifting hook to the manhole cover is not compromised at any time during any of the lifting processes. The normal movement of manhole covers, once the user has attached the lifting tool to the cover and attempts to pull the cover in an effort of lifting the cover and moving it to the side, especially the large and heavy models, is to tilt in position in an effort to fall downward into the cavity. The fact that the manhole covers are round and have a very close fitting into the manhole itself minimizes such a problem, however the person assigned to removing the covers must continue to control the manhole covers, regardless of their movements.

Construction

The present invention is directed towards lifting devices for use with access space covers employed to control access to spaces of underground systems. Such covers may be manholes for use with sewer and water systems and underground electric equipment spaces or gratings for use with subsurface equipment lifting systems, storm drains and the like. The differences between the covers consist principally of various sizes and shapes of the eyelets, holes or slots used with a specific cover.

With respect now to the drawings, a plan view of the lifting device is shown at numeral 10. A lifting shaft 11 is formed of a 60" piece of schedule 80 pipe plugged at handle end 12 and at pulling end 13. A freely sliding 4" sleeve 14 includes a flange 14A with a hole 15 therethrough for a first connecting ring 16 to which chain 18 is attached. The chain 18 is attached via a second connecting ring 17 security and lifting or chain hook 19.

A pulling hook 22 is attached to rod 11 via bolts 20 through openings 20A and nuts 21 and washers 21A, if needed.

The distance between hook members 19 and 22 is variable because of the free movement of sleeve 14 as shown by arrow 23.

Figure 2:
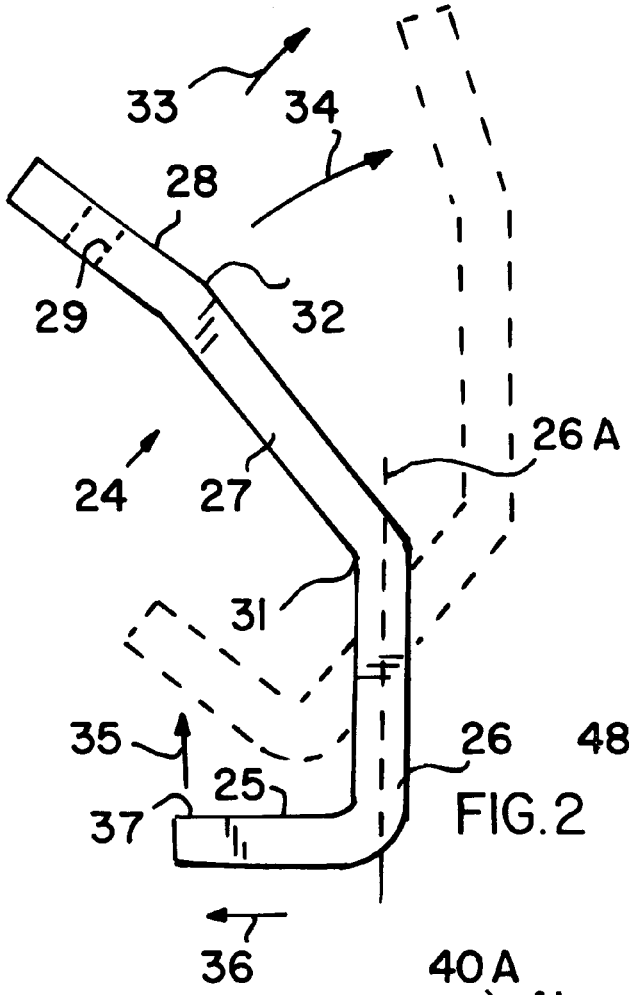
FIG. 2 is a diagrammatic view of one embodiment of the chain hook used in the device of FIG. 1 in accord with the present invention shown in the initial grasping point in solid line and the rotation of the hook to the broken line position during lifting of a manhole cover.

In FIG. 2, one embodiment of chain hook 19 is shown at 24. The hook 24 made of flat metal stock and is substantially planar and includes a leg member 25 and a shank formed of portion 26 with straight axis 26A.

First portion 26 is disposed at a substantially right angle at point 30 to leg 25. A connection portion 27 is disposed at point 31 approximately 45° from portion 26. The second portion 28 is disposed at an angle of 5°-15° at point 32, preferably 10°, from first portion 27. Second portion 28 includes an opening 29 offset from axis 26A therethrough for a connecting ring 17.

FIG. 2 also illustrates the movement of chain hook 24 from the position shown in solid line when a hole or slot 62 (FIGS. 6-7) is engaged to the position shown in broken line as lifting takes place. Upper lifting force movement arrow 33 illustrates lifting of chain hook 24, which causes the hook 24 to move as shown by arrow 34. Inward force movement arrows 35, 36 illustrate movement of the lower portion of hook 24 to provide a secure and stable lifting action by contact between grasping face 37 of leg 25 and a manhole 58.

Figure 3:
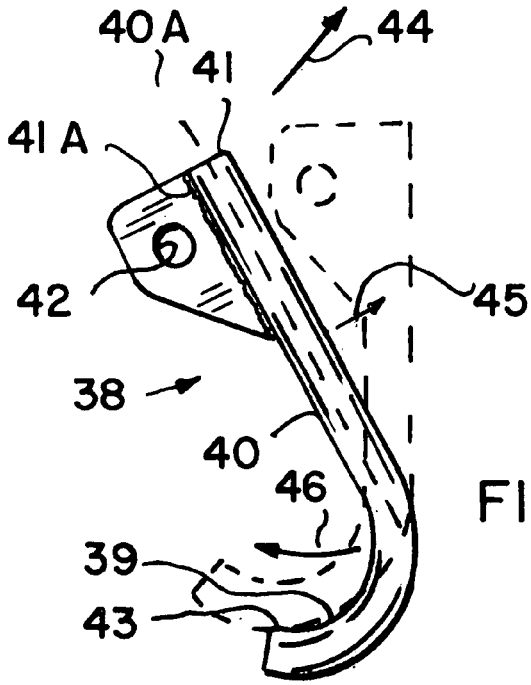
FIG. 3 is a diagrammatic view of an alternative chain hook for use with the device of FIG. 1 illustrating the initial grasping position in solid line to the lifting position shown in broken line.

FIG. 3 illustrates an alternate embodiment of hook 19. Round metal stock is used to form chain hook 38 with an arcuate gripping portion 39 and a shank 40 having straight axis 40A. A bracket 41 is offset from axis 40A and is formed on shank 40 and includes the offset opening 42 for a connecting ring 17. Importantly, opening 42 is offset from axis 40A to cause the chain hook 38 to rotate from the solid line initial grasping point to a substantially vertical position shown in broken line position to properly place arcuate gripping face 43 of portion 39 against manhole cover 58. Upper lifting movement arrow 44 illustrates lift with result movement arrows 45 and 46 to rotate chain hook 38 for a secure and stable grasping action.

Figure 4:
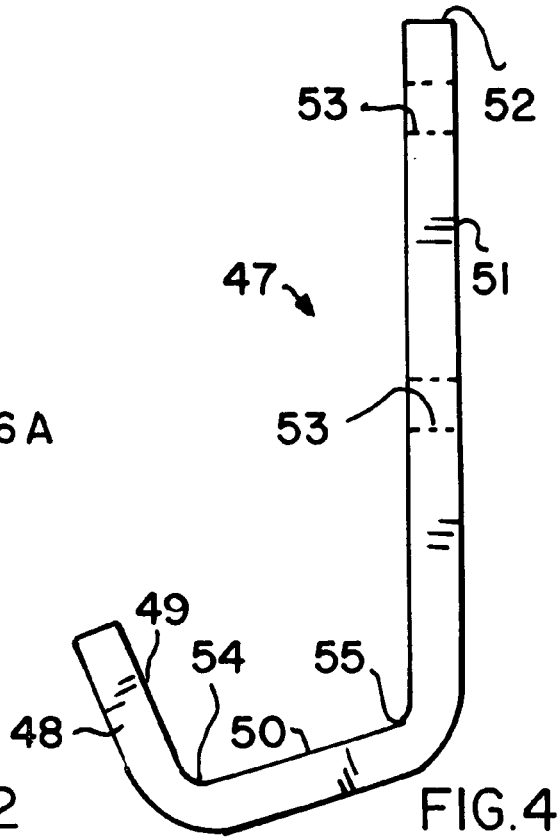
FIG. 4 is a diagrammatic view of the pulling hook used in the present invention.

FIG. 4 illustrates the handle or pulling hook 22 in the form of hook member 47. Lower leg element 48 has grasping face 49, a first shank portion 50 bent at 90° at point 54 and bent at approximately 70° at point 55 to form second shank portion 51. Adjacent handle end 52 are spaced bolt openings 53 used for attachment as shown in FIG. 1.

Figure 5:
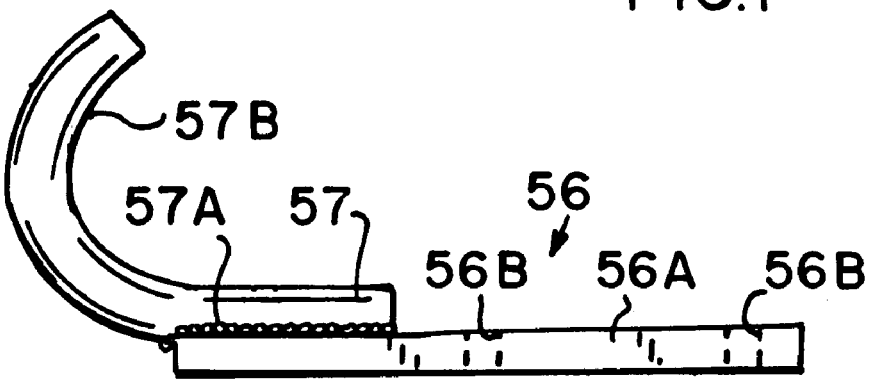
FIG. 5 illustrates a flat stock and round stock pulling hook for use with grating covers in accord with the present invention.

FIG. 5 illustrates a handle pulling hook 56 formed of a flat stock shank 56A with openings 56B for use with bolts 20 and a round stock hook member 57 and grasping face 57B secured via weldment 57A.

Figure 6:
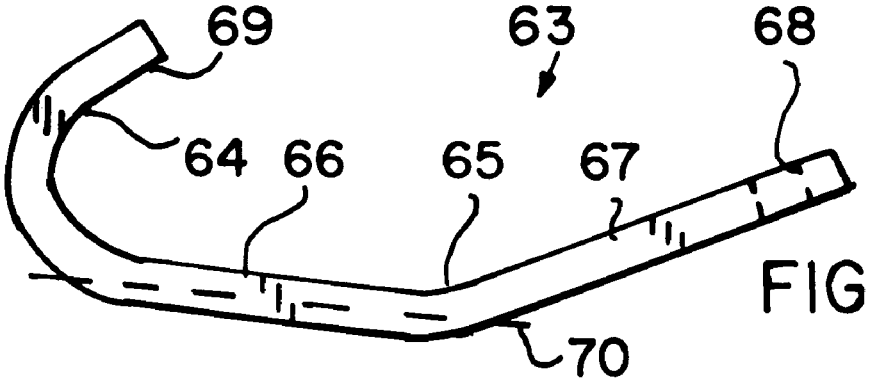
FIG. 6 illustrates a flat stock lifting hook for use with grating covers.
Figure 7:
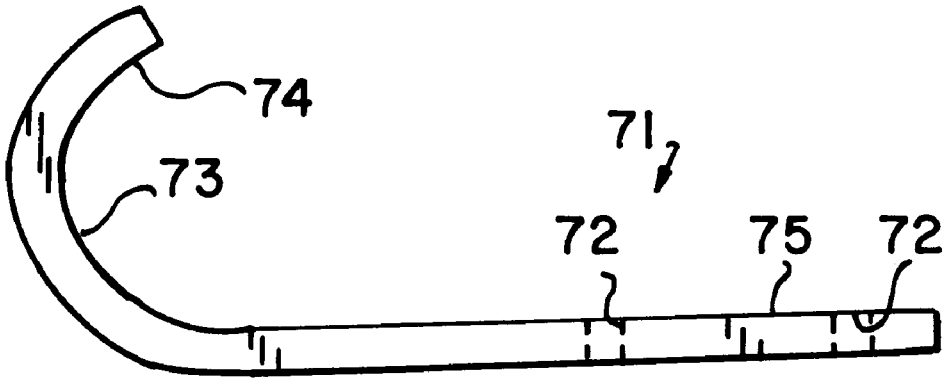
FIG. 7 illustrates a flat stock pulling hook for use with grating covers.

With respect to FIGS. 6 and 7, hooks used with grating covers are shown. In FIG. 6, a flat stock grate lifting hook 63 includes engaging hook member 64 with grasping face 69 with a 20° bend offset from straight axis of shank 66. The offset connecting member 67 has an opening 68 for connection to chain 18.

FIG. 7 shows grate handle pulling hook 71 formed of flat stock. Engaging hook member 73 has grasping face 74 and shank 75 with two openings 72 for attachment to rod 11 via bolts 20, as before.

Figure 8:
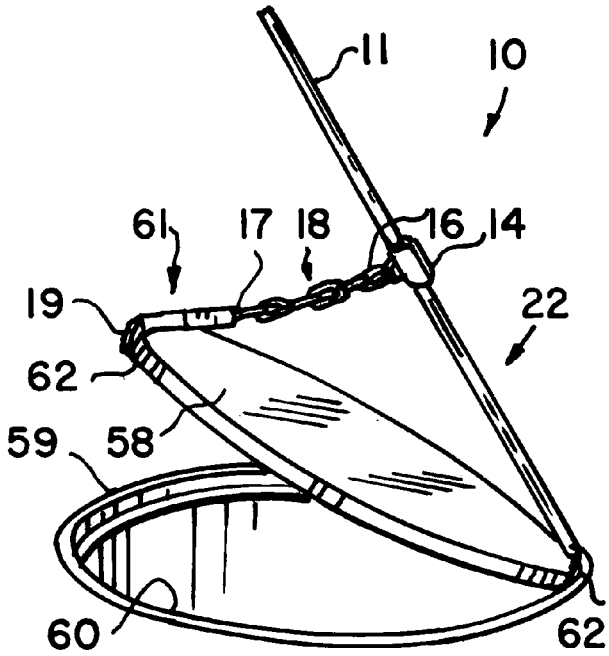
FIG. 8 shows the device of FIGS. 6 and 7 attached to a representative manhole cover.
Figure 9:
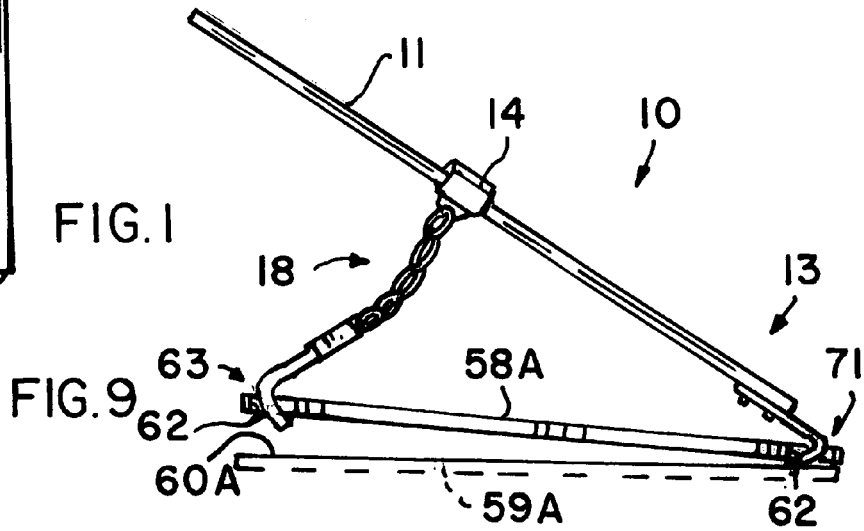
FIG. 9 shows the device of FIGS. 6 and 7 attached to a representative grating cover.

FIGS. 8, 9 illustrate the use of device 10 to lift a manhole cover 58 or grating 58A mounted on a frame 59, 59A around an access space such as manholes 60, 60A. Lifting point is at 61. Covers 58, 58A include a pair of diametrically opposed holes or slots 62 that are standard in the art.

The choice of chain hook 24 or 38 depends upon whether the cover 58, 58A are underground electric covers or sewer gratings, or water covers which are different in form in most applications.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed as new and what it is desired to secure by Letters Patent of the United States is:

1. An access space cover lifting device for lifting an access cover having at least two spaced lifting holes or slots therein, an elongated rod for use as a lifting lever, said rod having respective first and second end portions, a first lifting hook affixed to said end portion for engagement with a first of such holes or slots, a sleeve freely slideably mounted on said rod between said end portions, a second lifting hook, a flexible elongated element attaching said second hook to said sleeve, said second hook member having a shank with a straight axis and a lower gripping element, the improvement comprising an upper connecting portion extending laterally of said axis and located substantially in an the same direction and spacedly with respect to said gripping element, said connecting portion having an opening to connect said flexible element thereto, said opening being angularly offset from said axis and said shank to provide a force tending to rotate said second hook toward such access cover into secure and stable engagement of said second hook lower gripping element with a manhole cover when a lifting force is applied at said opening via said flexible element.

2. The device as defined in claim 1 wherein said shank and said gripping element are formed of round metal stock.

3. The device as defined in claim 1 wherein said shank, said element and said connecting portion are in a same plane.

4. The device as defined in claim 1 wherein said flexible element is a chain.

5. The device as defined in claim 1 wherein said first end of said rod includes an opening therethrough said first hook including a shank having at least one opening therethrough, at least one fastener passing through both said openings respectively of said rod and said first hook to attach said first hook to said rod.

6. An access space cover lifting device for lifting an access cover having at least two spaced lifting holes or slots therein comprising an elongated rod for use as a lifting lever, said rod having respective first and second end portions, a first lifting means including a first hook and an attachment to affix said first hook to said first end portion for engagement with a first of such holes or slots, a sleeve freely slideably mounted on said rod between said end portions, a second lifting means including a second hook attached to said sleeve for engagement with the other hole or slot, a flexible elongated element attaching said second hook to said sleeve, said second hook having a shank with a straight axis and having a lower leg element, the improvement comprising an upper connection member attached to said shank and having a first portion formed at a first angle to said axis, a second portion being disposed laterally from said first portion, said second portion including an opening for connecting said second hook to said sleeve, said opening being offset angularly form said axis and said shank, said second hook when vertical lifting force is applied to said opening via said flexible element rotating said second hook lower leg element toward an access cover into secure engagement therewith.

7. The device as defined in claim 6 wherein said hook is formed of flat metal stock.

8. The device as defined in claim 6 wherein said second hook includes a chain for attaching said hook member to said sleeve.

9. The device as defined in claim 6 wherein said first angle is approximately a 70° angle.

10. The device as defined in claim 9 wherein said second angle is approximately 10°.

11. The device as defined in claim 10 wherein said axis is disposed at a substantially right angle from said leg element.

12. The device as defined in claim 10 wherein said second angle is within the range of 5°-15°.

13. The device as defined in claim 9 wherein said shank, said element and said flange are in a same plane.

14. The device as defined in claim 6 wherein said first end of said rod includes at least one hole therethrough, said first hook includes a shank having at least one hole therethrough, said attachment passing through both said at least one hole to attach said first hook to said rod.

15. The device as defined in claim 6 wherein said rod includes a grip opening therethrough in said second end portion, an elongate strap member threaded through said grip opening for providing a secure grip for a user using said lifting device.

16. An access cover lifting device for lifting a access space cover having at least two spaced lifting holes or slots therein, an elongated rod for use as a lifting lever, said rod having respective first and second end portions, a first lifting hook affixed to said first end portion for engagement with a first of such holes or slots, a sleeve freely slideably mounted on said rod between said end portions, a second lifting hook, a flexible elongated element attaching said second hook to said sleeve, said second hook having a shank with a straight axis, and a lower gripping element, the improvement comprising an upper flange extending laterally of said axis and located substantially in an the same direction and spacedly with respect to said gripping element, said flange having an opening for connecting said flexible element thereto, said opening being offset angularly from said axis and said shank to provide a force tending to rotate said hook toward such access cover into secure and stable engagement of said second hook lower gripping member with an access space cover when a lifting force is applied at said opening via said flexible element.

17. The device as defined in claim 16 wherein said first end of said rod includes at least one hole therethrough, said first hook includes a shank having at least one hole therethrough, at least one fastener passing through both said at least one hole to attach said first hook to said rod.

18. The device as defined in claim 16 wherein said flexible element is a length of chain.

* * * * *